US007640983B2

(12) United States Patent
Hilleary et al.

(10) Patent No.: US 7,640,983 B2
(45) Date of Patent: Jan. 5, 2010

(54) METHOD TO CEMENT A PERFORATED CASING

(75) Inventors: Nathan Hilleary, Anchorage, AK (US); Robert Bucher, Houston, TX (US); Mike Martin, Anchorage, AK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 199 days.

(21) Appl. No.: 11/776,800

(22) Filed: Jul. 12, 2007

(65) Prior Publication Data

US 2009/0014177 A1 Jan. 15, 2009

(51) Int. Cl.
*E21B 33/14* (2006.01)
*E21B 33/161* (2006.01)

(52) U.S. Cl. ..... 166/287; 166/177.4; 166/285; 166/290; 166/291; 166/297

(58) Field of Classification Search ..... None
See application file for complete search history.

(56) References Cited

U.S. PATENT DOCUMENTS 1,910,442 A * 5/1933 Manning ..... 166/289
2,173,035 A * 9/1939 Armentrout et al. ..... 166/381
2,452,920 A * 11/1948 Gilbert ..... 166/297
5,074,360 A * 12/1991 Guinn ..... 166/281
5,318,121 A * 6/1994 Brockman et al. ..... 166/313
5,526,880 A * 6/1996 Jordan et al. ..... 166/291
5,598,890 A * 2/1997 Richard et al. ..... 166/276
5,697,441 A * 12/1997 Vercaemer et al. ..... 166/285
6,668,923 B2 * 12/2003 Vincent et al. ..... 166/253.1

* cited by examiner

*Primary Examiner*—George Suchfield
(74) *Attorney, Agent, or Firm*—David Cate; Robin Nava; Charlotte Rutherford

(57) ABSTRACT

The invention discloses a method of treating a zone of a well comprising a wellbore, a tube which is permeable to settable material, said tube forming an annulus with the wellbore; and wherein said zone is located in the annulus, the method comprises the steps of: (i) placing inside said tube a first plug; (ii) creating on said tube a first opening and a second opening, so that: the zone be located between said first and second openings and the first opening be located between said zone and said first plug; (iii) placing inside said tube a second plug, so that said second plug is located between said second opening and said zone; (iv) injecting a settable material inside said tube between said second and first plugs, so that settable material fills the annulus and the zone by passing through the first opening; and (v) eliminating said second plug.

27 Claims, 18 Drawing Sheets

METHOD TO CEMENT A PERFORATED CASING

FIELD OF THE INVENTION

The present invention broadly relates to well cementing. More particularly the invention relates to servicing apparatus for completing downhole wells from a subterranean reservoir, such as for instance an oil and gas reservoir or a water reservoir comprising a liner, a perforated tubular or any type of permeable tubular or screen.

DESCRIPTION OF THE PRIOR ART

After a well has been drilled, the conventional practice in the oil industry consists in filling the well with a metal casing. The casing is lowered down the hole and cement is pumped inside the casing and returns through the annulus where it is allowed to set. Lining the well aims at a dual purpose: preventing the bore walls from collapsing and isolating the various geological strata and thus, avoiding exchange of fluids between them. Furthermore, it can be useful also for different reasons to fill the well with a permeable screen (meaning not impermeable as metal casing) as perforated tubular, tubular with other openings, slotted liner, sand screen or expandable screen. Use of such permeable screen aims for example in preventing the bore walls from collapsing, and allowing the oil to flow from production zones into the horizontal hole by retaining debris. However, when a permeable screen is present downhole, there is no simple way to cement the annulus. Effectively, conventional technique where cement is pumped inside the casing to be returned through the annulus will not work, because the cement will pass through the first openings of the permeable screen and no cement will be pumped at the other extremity.

U.S. Pat. No. 6,817,415 discloses a method of sealing an annulus surrounding a slotted liner by using magnets placed on the outside of the liner. However, those magnets have to be placed prior to running in the hole. And so, if the liner is already in place underground then it is not possible to place the magnets outside the liner. Further, U.S. Pat. No. 6,817,415 does not address density differences between the fluid and cement and relies on a magnetic field to prevent cement slumping.

Another technique uses external casing packers (ECP) to isolate the annulus of a slotted liner. However the ECP must be placed on the liner prior to running the liner into the hole. Also, a significant number of liners are already in place underground where devices/ports for cementing were not included in the original design.

Other techniques have addressed isolation of liners already placed downhole. U.S. Pat. No. 5,697,441 discloses a packer called a Chemical External Casing Packer (CECP), which is able to inject a gel into the annulus developing thixotropic properties to seal off annular flow. However this method has proven operationally difficult to realize and is not currently used in the field. U.S. Pat. No. 6,253,850, discloses an expandable device which is placed underground to expand the slotted liner against the formation. Then a solid liner is placed to seal the wellbore. However, this method also include some problems as the quality of the formation/liner seal, as excessive splits or rips occurring during the expansion of the slotted liner. All this may compromise the quality of the annular seal. Additional working time is then required to pump resin into the liner and seal the leaks.

Hence, it remains the need for a method of cementing the annulus or a method of treatment of the earth formation, behind a perforated casing, a slotted liner or an expandable and permeable screen which avoid drawbacks cited therein.

The invention described herewith provides an improvement on the prior art, because it can be implemented on the large number of horizontal slotted liners already deployed underground. Also, the current invention has operational simplicity, using conventional techniques of cementing, and individual fluid systems that have proven to be pumpable in the field. Some problems associated with traditional cementing techniques were avoided e.g. cement slumping (where the cement moves after placement causing channeling, contamination and poor coverage), cement falling back through the slots and stuck pipe (where cement falls on top of the placement mechanism). As such, this invention increases the probability of quality cement coverage, reduces cement contamination due to slumping, prevents cement falling through the slots and reduces the probability of undesirable stuck pipe situations.

SUMMARY OF THE INVENTION

A method of treating a zone of a well is disclosed, the well comprises a wellbore, a tube which is permeable to settable material, the tube forming an annulus with the wellbore; and wherein the zone is located in the annulus. The method comprises the steps of: (i) placing inside said tube a first plug; (ii) creating on said tube a first opening and a second opening, so that: the zone be located between said first and second openings and the first opening be located between said zone and said first plug; (iii) placing inside said tube a second plug, so that said second plug is located between said second opening and said zone; (iv) injecting a settable material inside said tube between said second and first plugs, so that settable material fills the annulus and the zone by passing through the first opening; and (v) eliminating said second plug. Preferably, the wellbore section to be treated is highly deviated (45 degrees to 90 degrees) and contains an area open to flow (i.e. mesh sand screens or slotted liner). Initially a device to divert flow (such as a packer or viscous pill) is placed inside the liner and below the zone of interest. The annulus between the wellbore and placement device (coil tubing/drill pipe) is opened to allow flow back to surface.

Advantageously, the method further comprises the step of drilling inside said tube excess of material and/or the step of waiting that the setting material sets. Also in a preferred embodiment, the method further comprises after the step of drilling inside said tube, the step of cleaning the inside of said tube to remove debris.

Preferably, the method further comprises after the step of placing inside said tube a second plug, the steps of: (i) injecting inside said tube between said second and first plugs, a fluid comprising lost circulation material; and (ii) circulating said fluid inside the tube and the annulus via the first and second openings, such that lost circulation material fills surface of the tube and said tube becomes impermeable to said settable material. Advantageously said fluid spacer contains fibers. The lost circulation material plugs the slots in the liner and the flow is diverted axially toward the first opening. The spacer is then diverted through the first opening and flows back along the liner/formation annulus toward the surface. The lost circulation material concentration is sufficient to plug the smaller slots of the slotted liner but not sufficient to plug the larger first opening. Also the density of the fluid comprising fibers and the density of the settable material are chosen preferably the same.

In a first embodiment, the step of creating the first and/or second opening is done by perforating the tube or by other techniques such as mechanical cutting tool or abrasive techniques (commercially knows as ABRASIJET™) which create the opening by focusing high velocity abrasive fluid onto the liner. In a second embodiment, the step of placing the second plug is done by inflating a packer surrounding a setting pipe inside the tube. And so the step of injecting the settable material is done by injecting the settable material by the setting pipe. Also, in said second embodiment preferably, the step of eliminating the second plug is done by deflating the packer.

In another embodiment, the wellbore comprises a fracture near the zone, and the method further comprises the step of pre-treatment of the wellbore by filling the fracture with a gel.

In another embodiment the method further comprises after the step of injecting the settable material, the step of injecting inside said tube between said second and first plugs, a second fluid following the settable material in such a way that said second fluid fills only the tube between first and second plugs and not do go in the annulus. Said second fluid is preferably of the type spacer, advantageously with a lost circulation material e.g. fibers. Advantage of this further step is that the settable material will be contaminated with the spacer, or even will be replaced by the spacer. So, the drilling step will be easier to realize, because volume of set material to drill will be reduced or at least weakened due to the presence of a mixture set material/spacer.

In another aspect it is disclosed a method of cementing a zone of a well comprising a wellbore, a tube which is permeable to cement slurry, said tube forming an annulus with the wellbore; and wherein said zone is located in the annulus, the method comprising the steps of: (i) placing inside said tube a first plug; (ii) creating on said tube a first opening and a second opening, so that: the zone be located between said first and second openings and the first opening be located between said zone and said first plug; (iii) placing inside said tube a second plug, so that said second plug is located between said second opening and said zone; (iv) injecting cement inside said tube between said second and first plugs, so that cement fills the annulus and the zone by passing through the first opening; and (v) eliminating said second plug; and (vi) waiting that the cement sets.

Preferably, the method further comprises after the step of placing inside said tube a second plug, the steps of (i) injecting inside said tube between said second and first plugs, a fluid comprising lost circulation material; and (ii) circulating said fluid inside the tube and the annulus via the first and second openings, such that lost circulation material fills surface of the tube and said tube becomes impermeable to said cement slurry.

Advantageously, the cement is used with a lost circulation material e.g. fibers. Preferably, the density of the fluid comprising fibers and the density of the cement slurry are the same. The slots between the upper and lower perforations are already partially plugged due to the spacer and lost circulation material combination. Lost circulation material in the cement is pushed against the existing lost circulation material in the slots and so that radial flow is blocked and diverted axially along the inside of the slotted liner. The cement flows through the first opening in the lower end and into the formation/liner annulus. Rheology hierarchy is maintained so the cement has higher viscosity than the spacer, which has higher viscosity than the original wellbore fluid. This ensures effective fluid separation while placing the fluids in the annulus. The volume of the cement is calculated so the cement in the annular section does not overlap with the placement device i.e. the cement injected is calculated to be the cement needed for the zone. This prevents the cement from falling back on top of the placement mechanism therefore preventing stuck pipe. Slumping (where cement is placed and then moves due to density differences) is prevented because the initial wellbore fluid, spacer and cement are designed with similar density (+/−2 ppg). The cement from inside the slotted liner can then be drilled out, creating an annular seal in the zone of interest.

Preferably the method comprises the step of drilling inside said tube excess of set cement or the step of cleaning the inside of said tube to remove debris after drilling.

Drilling out the cement will result in debris invading the injection/production zone. In addition the spacer and lost circulation material fluid will contaminate zones around the upper and lower ends of the cement section. This contamination increases the wellbore skin of this region (i.e. reduce the ability of the injected/produced fluids to flow in/out of the slotted liner). These contaminated regions are then cleaned up using a high powered jetting device.

In another embodiment the method further comprises after the step of injecting cement, the step of injecting inside said tube between said second and first plugs, a second fluid following cement in such a way that said second fluid fills only the tube between first and second plugs and not do go in the annulus.

BRIEF DESCRIPTION OF THE DRAWINGS

Further embodiments of the present invention can be understood with the appended drawings.

DETAILED DESCRIPTION

The present invention involves the use of two inflatable packers (or similar) that selectively isolates a portion of a permeable tube such as a perforated casing, or a slotted liner or an expandable and permeable screen, this isolation allowing the further treatment of the annulus zone between the permeable tube and the borehole, such treatment can be for instance a cementing operation to stop or reduce water arrivals in that zone. The typical applications for which the method of the invention can be used include sand control and support of wellbore producing formations, in water, oil and/or gas wells. The method of the invention can be used also in all type of geometry of wellbores, but the method is particularly preferred in application with highly deviated or horizontal wellbores.

Particularly, the invention relates to horizontal liner cementing and placement of cement between a highly deviated slotted liner and the formation. The method has been optimized so that quality cement can be placed in the slotted liner/formation annulus of a highly deviated wellbore.

Method of the invention is used in a well comprising a permeable tube 10. The permeable tube 10 is placed inside the well and forms an annulus 11 between said tube 10 and a wellbore 12. The permeable tube 10 is a perforated tubular, a tubular with other openings, a slotted liner or a screen (standalone, expandable, prepacked, or a perforated tube surrounded by a screen) or any type of tubular with communication means. The tube 10 is at least permeable to one material—permeable, meaning allowing the flowing of said one material through said tube—. Further, the tube 10 can be impermeable or can play the rule of a barrier to another material—impermeable, meaning not allowing the flowing of said another material through said tube—. In instance, the material is preferably cement slurry. The tube 10 can also be for example a type of sieve, where the tube allows the crossing of a material or morphology of material, as water or fine sand; and blocks the crossing of another material or morphology of material, as stone or medium sand.

Figure 1A:
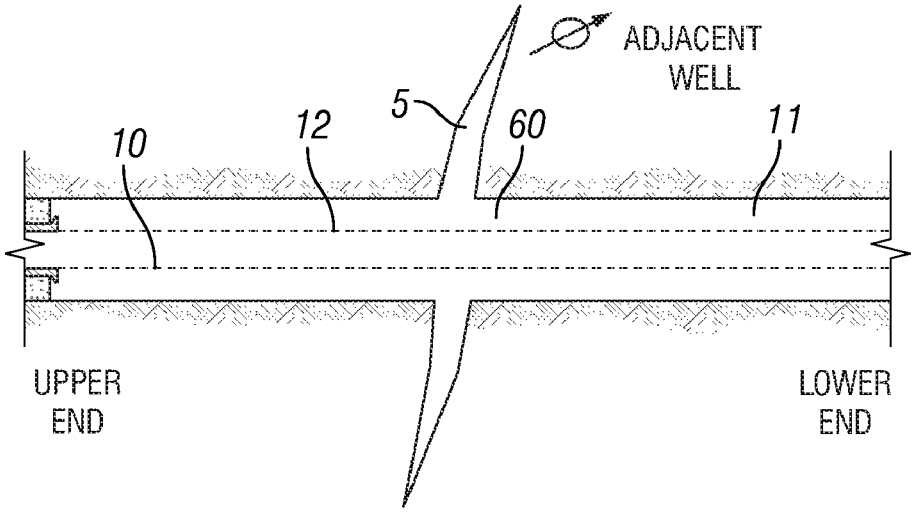
FIGS. 1A to 1F show a schematic diagram illustrating the first steps of the method of the invention: placement of a first plug.

The method of the invention is a method of treatment of a zone 60 of the well which can be called a non-invasive method. Zone is defined as a part of the well or a region of the well which is delimited, but which can be quite small—from one cubic meter to ten cubic meters—and which can also be quite large—from hundred cubic meters to ten thousand cubic meters—. The zone 60 is located in the annulus 11. FIG. 1A shows, for example a fracture 5 producing e.g. a flow of water from stratum into the well through the annulus 11 and the tube 10. One example of realization can be using the method of the invention to shut off said flow of water without changing the structure of the tube 10. Further, the isolation in the annulus is essential to prevent the flow of water.

Figure 1B:
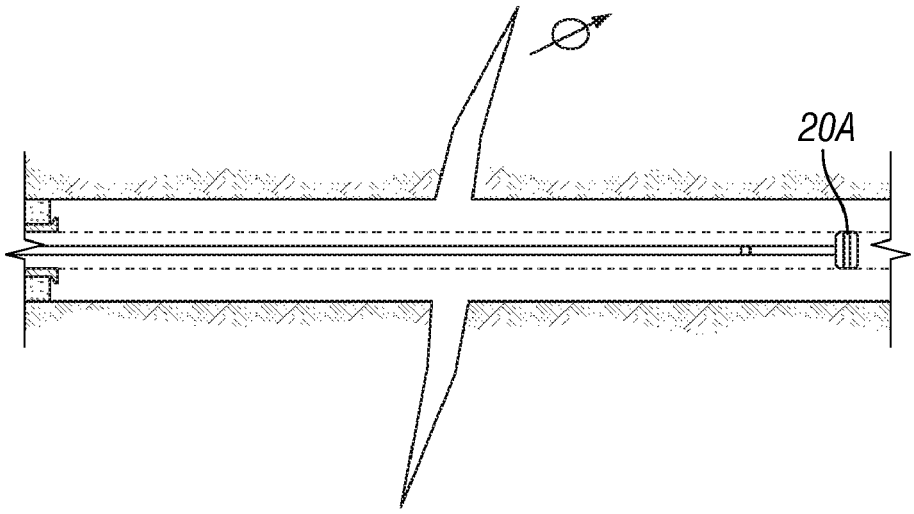
Figure 1C:
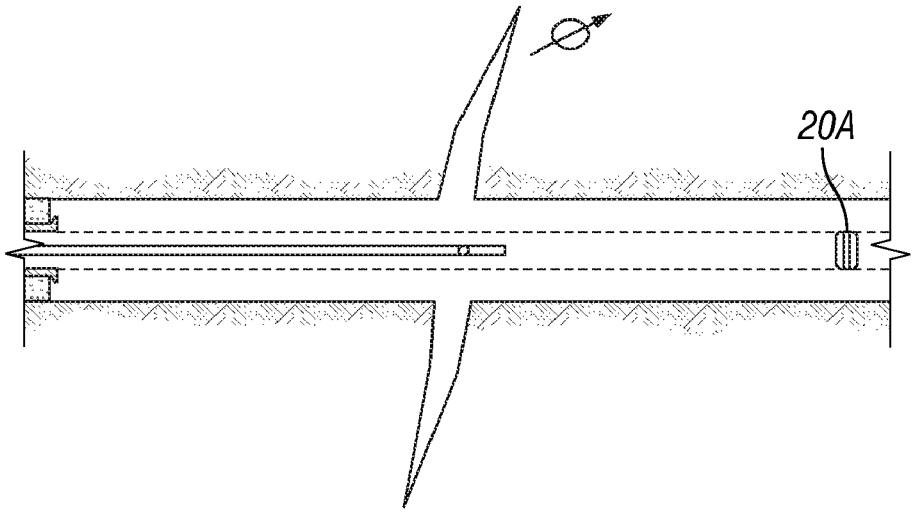
Figure 1D:
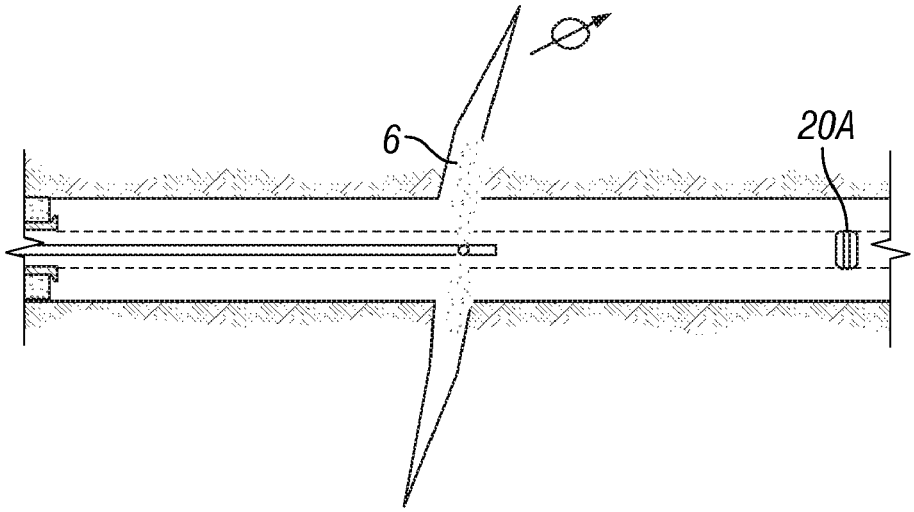
Figure 1E:
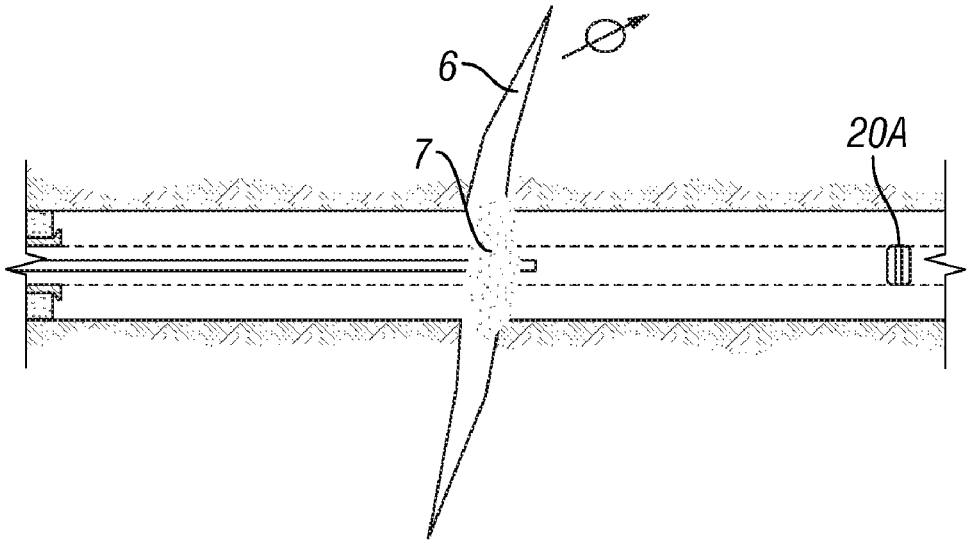
Figure 1F:
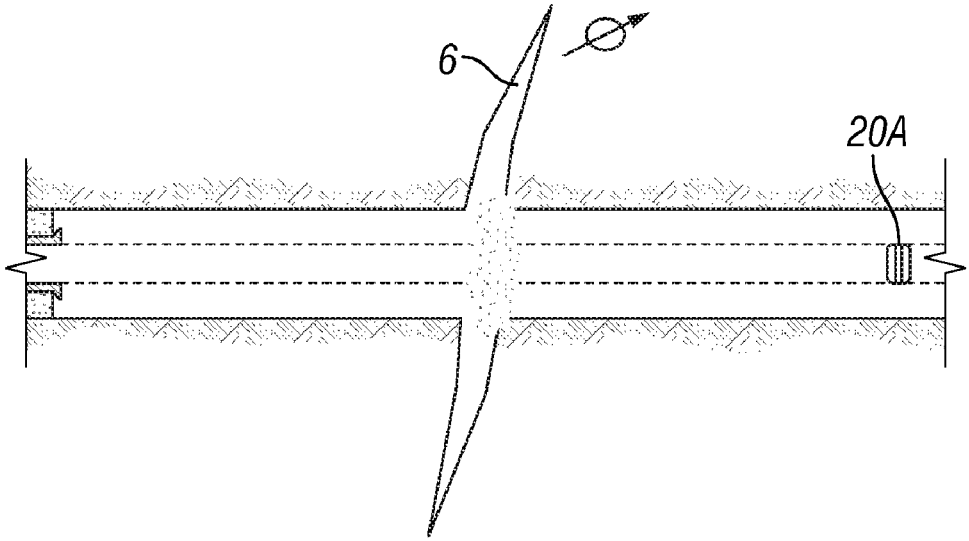

FIG. 1B shows the first steps of the method referring to the placement of a first plug 20A. The placement mechanism is done with a setting tube, such as a coil tubing or a drill pipe. The first plug is placed in the tube below the zone 60. When referring to position below or above the zone 60; it is meant below by going downhole in the well and above by going in direction of the surface. The purpose of the first plug is to divert axial flow inside the tube to radial flow. The first plug may be a gel or it may be a mechanical device such as a packer. An example of such a device is an easy drill plug which is made from soft material that allows the plug to be milled (drilled out) without high weight on bit (WOB) requirements. The setting tube is removed from the well after.

FIGS. 1C to 1F show an optional step of the method, where the fracture 5 is treated. A gel e.g. MARCIT™ gel 6 is injected with the setting tube inside the tube in the vicinity of the fracture to stop propagation of the fracture and to repair it. Other type of gel can be used, as for example commercial product ORGANOSEAL™. Said gel is after forced into the fracture by displacing it with Hydroxyethyl Cellulose (HEC) 7, after the gel is allowed to set. Result is that the fracture is filled in. Purpose of displacing with HEC is to prevent the gel from blocking the annulus (zone 60).

Figure 2A:
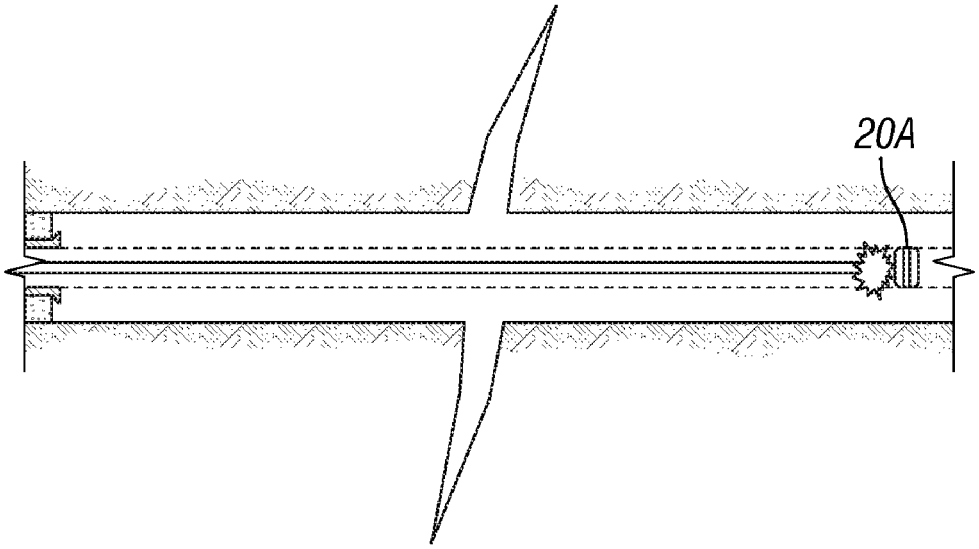
FIGS. 2A to 2C show a schematic diagram illustrating the further steps of the method of the invention: creating of first and second openings.
Figure 2B:
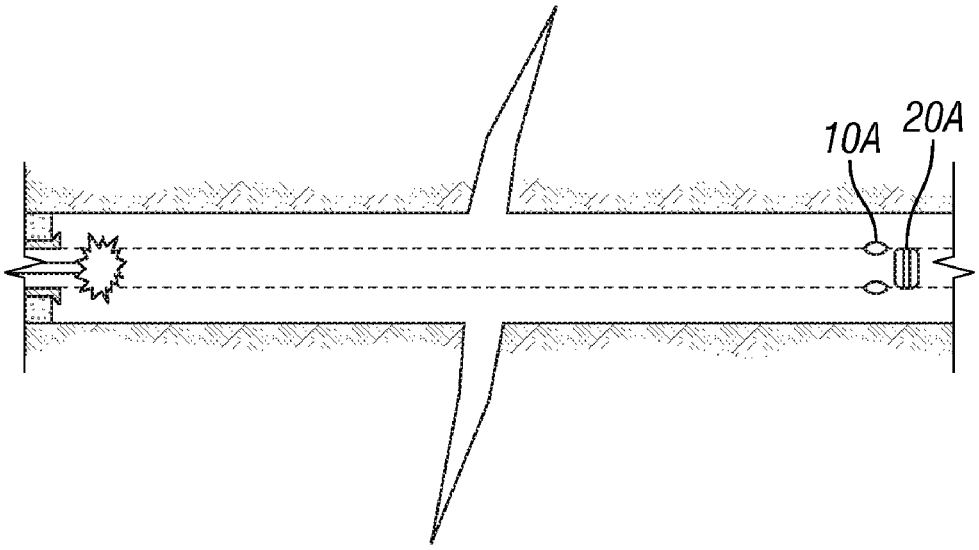
Figure 2C:
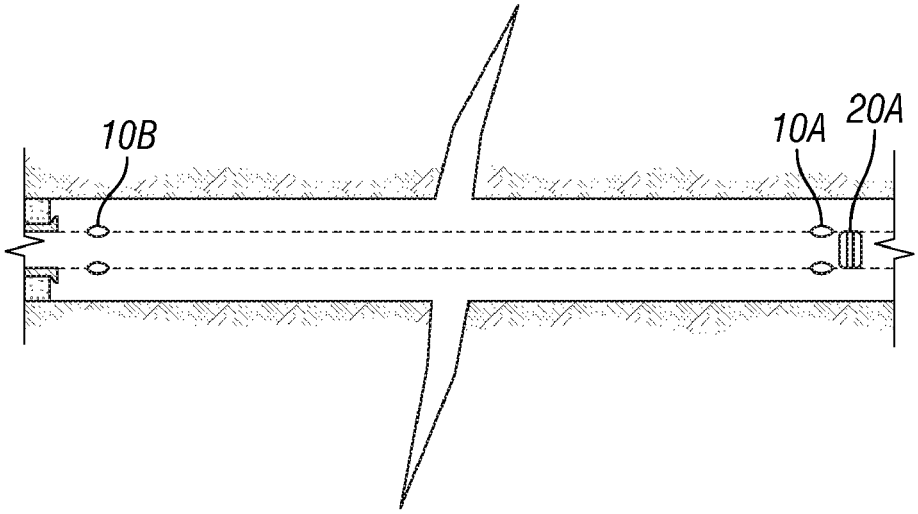

FIG. 2A shows the further step of the method referring to the creation of openings on the tube. At least a first opening 10A is created on the tube 10 above the first plug 20A and below the zone 60. The first opening is used to allow a greater passage for cement slurry. FIG. 2B shows the creation of a second opening 10B on the tube. At least second opening 10B is created on the tube 10 above the zone 60. Preferably, first and/or second openings are holes which are designed to have larger cross sectional area than the slots of the liner. The holes may be created by any device such as a mechanical cutting tool, abrasive techniques (commercially known as ABRASI-JET™) or a perforation gun. When perforation guns are used, penetration into the formation is not a priority. Therefore the perforating guns are configured to create holes in the liner without excessive formation penetration. FIG. 2C shows the tube 10 with both openings 10A and 10B.

Figure 3:
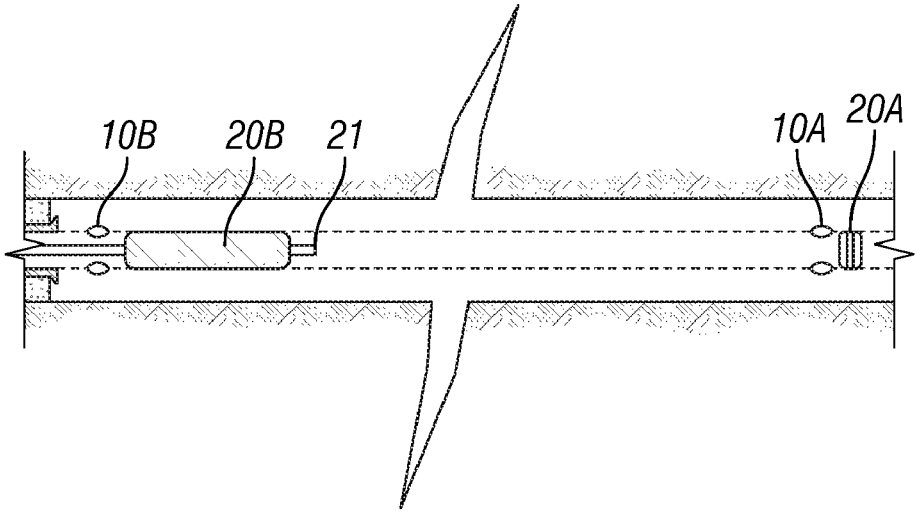
FIG. 3 shows a schematic diagram illustrating the further steps of the method of the invention: placement of a second plug.

FIG. 3 shows the further step of the method referring to the placement of a second plug 20B. The placement mechanism is done with a setting tube, such as a coil tubing or a drill pipe. The second plug 20B is placed below the second opening 10B and above the zone 60. The purpose of the second plug is to seal off the inner liner, diverting flow toward the lower region of the liner. By way of example of embodiments, the second plug can be an inflatable packer embodied on a setting pipe (e.g. coil tubing or drill pipe), i.e. a packer that inflates to seal the annulus between coil tubing and liner. Such commercial apparatus is known under the name COILFLATE™. Position of the second plug above the zone 60 is not critical; however it will minimize the risk of cement falling back onto the coil tubing or drill pipe.

Figure 4A:
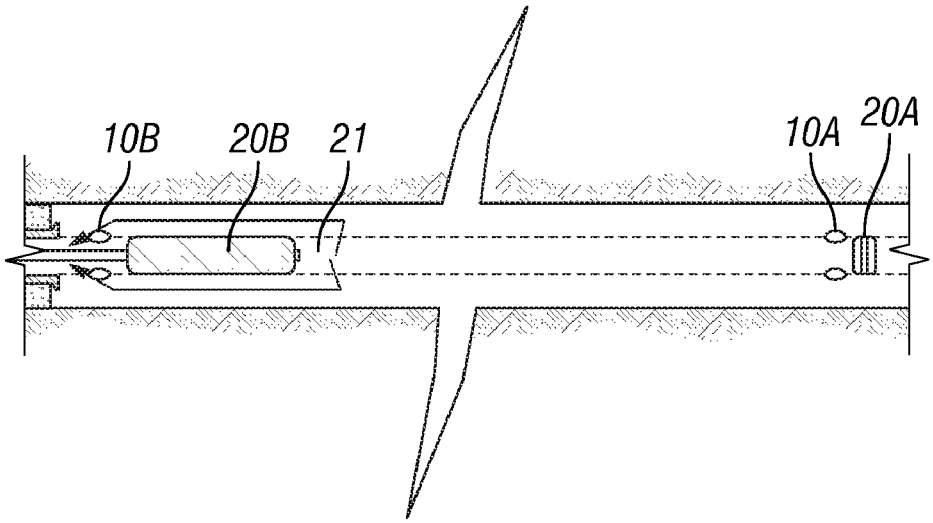
FIGS. 4A to 4H show a schematic diagram illustrating the optional further steps of the method of the invention: injection of a fluid in the well.

FIG. 4A shows the second plug deployed within the well. Once the COILFLATE™ is inflated, the coil tubing/drill pipe may be full of excess fluid such as water or brine. Spacer is pumped into the coil tubing and the excess fluid ahead can be circulated to the surface by opening the wellbore annulus valve at surface. This allows the excess fluid ahead of the spacer to circulate over the packer and toward the surface.

Figure 4B:
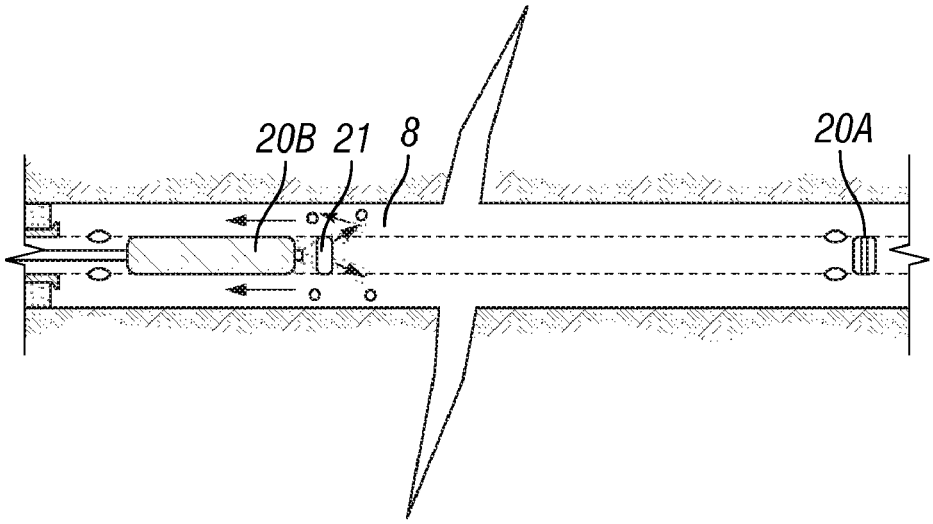
Figure 4C:
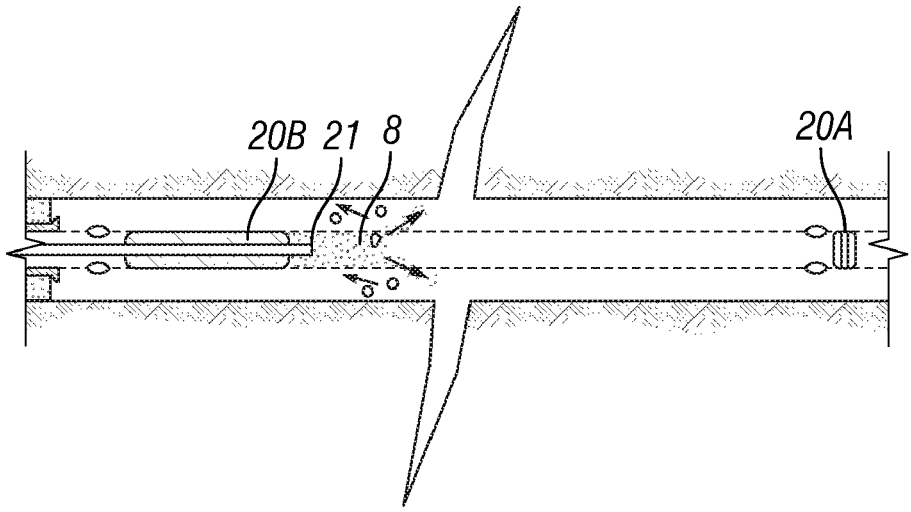
Figure 4D:
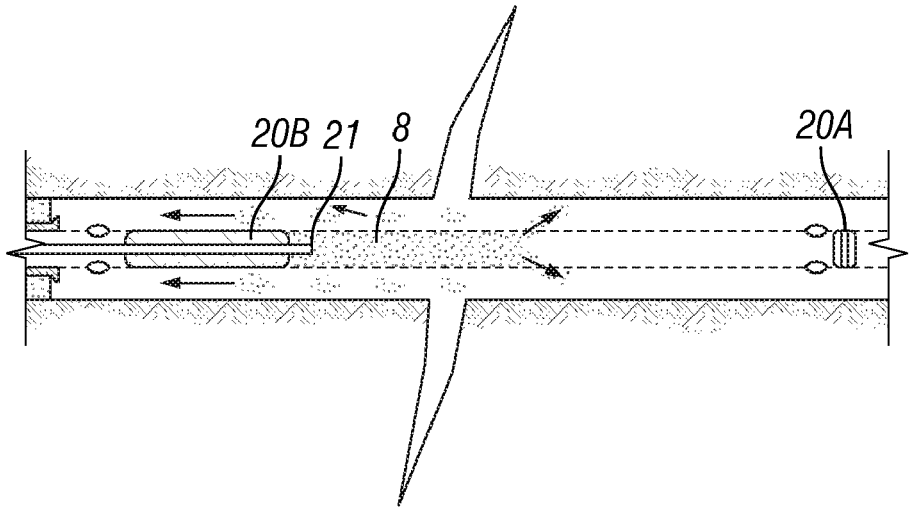
Figure 4E:
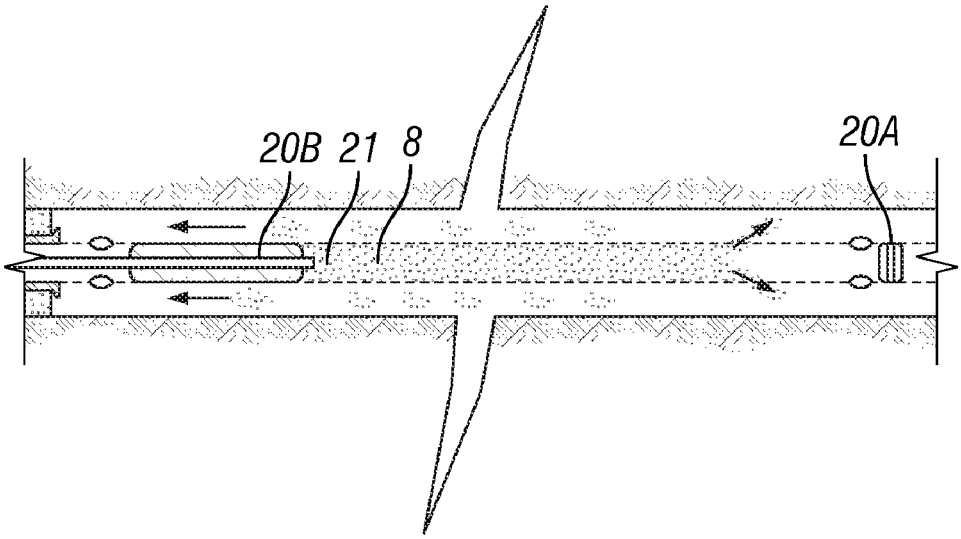
Figure 4F:
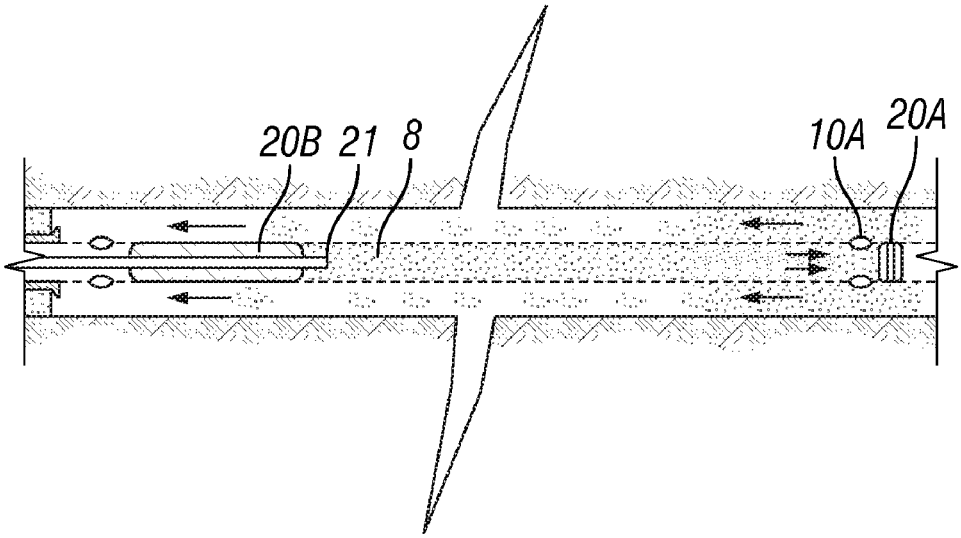
Figure 4G:
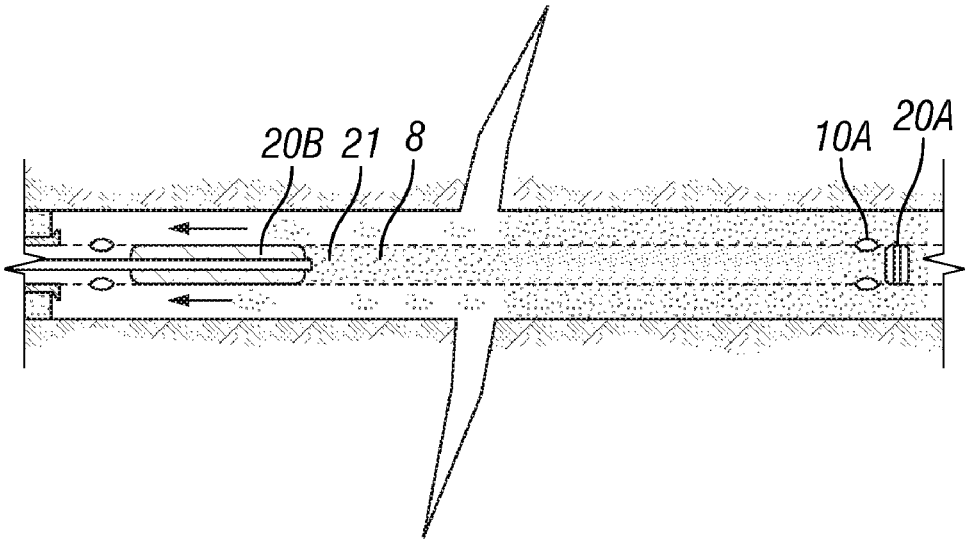
Figure 4H:
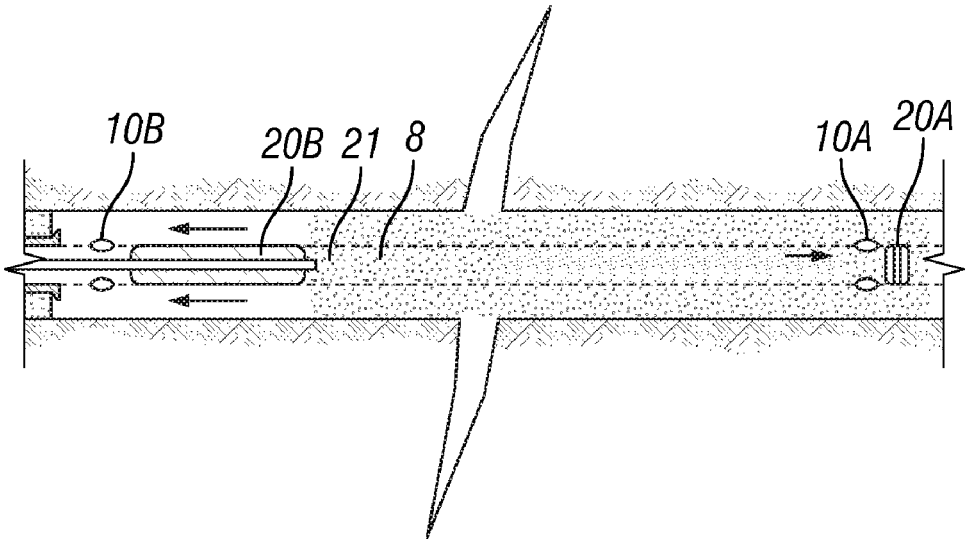

FIGS. 4B to 4H show an optional further step of the method referring to injection of fluid with fibers. However other type of lost circulation material can be used. After traveling through the coil tubing (or drill pipe) a fluid 8 exits the nozzle/bit 21. Some fluid will leak off into the annulus. Preferably, the fluid contains fibers (the fibers can be commercial fibers known as CEMNET™ or FIBERFRAC™). At the time the fluid leaks off into the annulus, the fibers begin a process of plugging the small slots in the tube 10 (FIGS. 4B-4C). The fibers continued to plug the slots and the fluid continued to flow axially along the tube (FIGS. 4D-4E). Once the fluid and fibers reach the first opening 10A, the fluid is diverted to the annulus 11. The fibers concentration is not sufficient to plug the first opening (FIG. 4F). The first plug below the first opening assists with the diversion of fluid flow from inside the tube to the annulus. However the presence of the first plug is not essential for causing the diverted flow. Once the fluid passes the second packer, the fluid is diverted to flow from the annulus, through the second opening and towards the surface (FIGS. 4G-4H). This may be achieved thanks to the fact that the surface is open to flow from the wellbore.

Figure 5A:
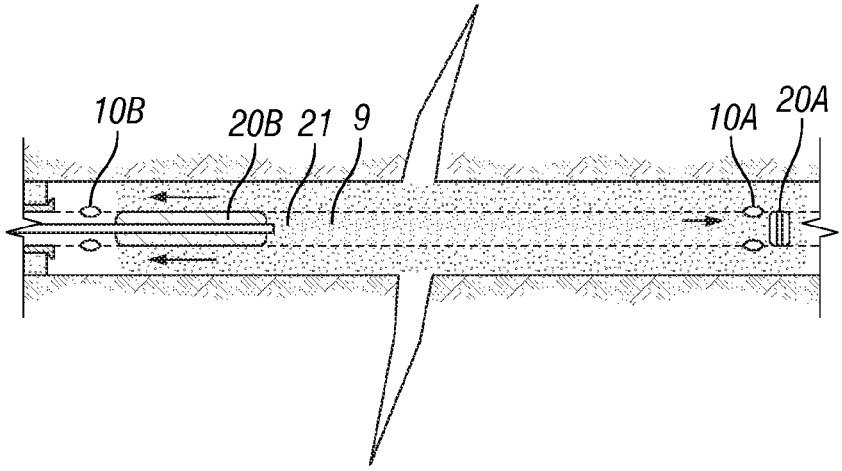
FIGS. 5A to 5E show a schematic diagram illustrating the further steps of the method of the invention: injection of fluids containing lost circulation material (spacer followed by cement)
Figure 5B:
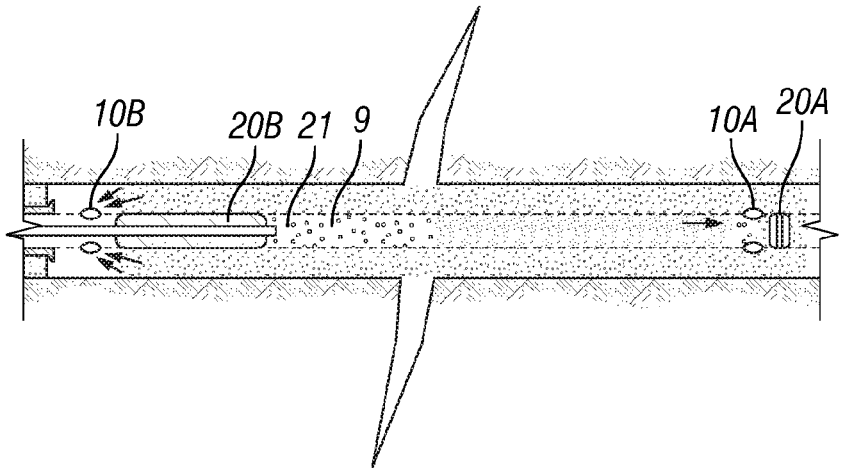
Figure 5C:
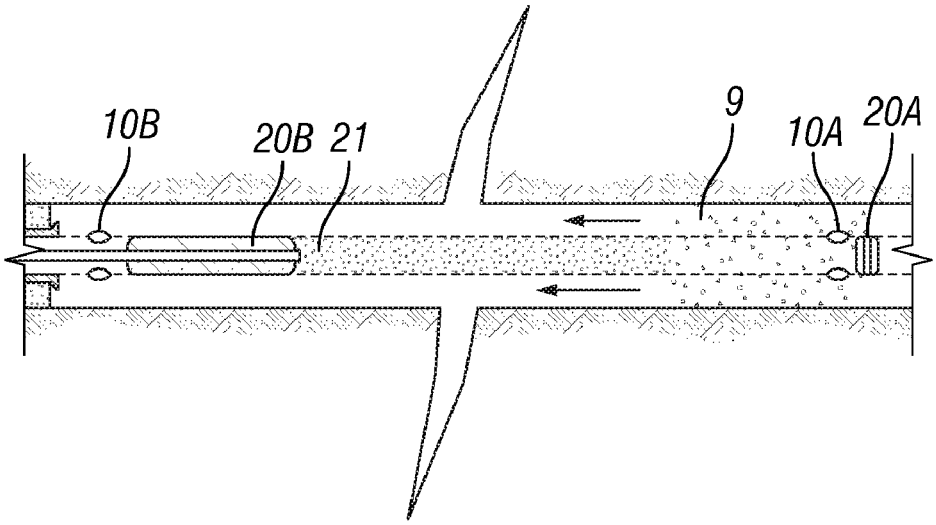
Figure 5D:
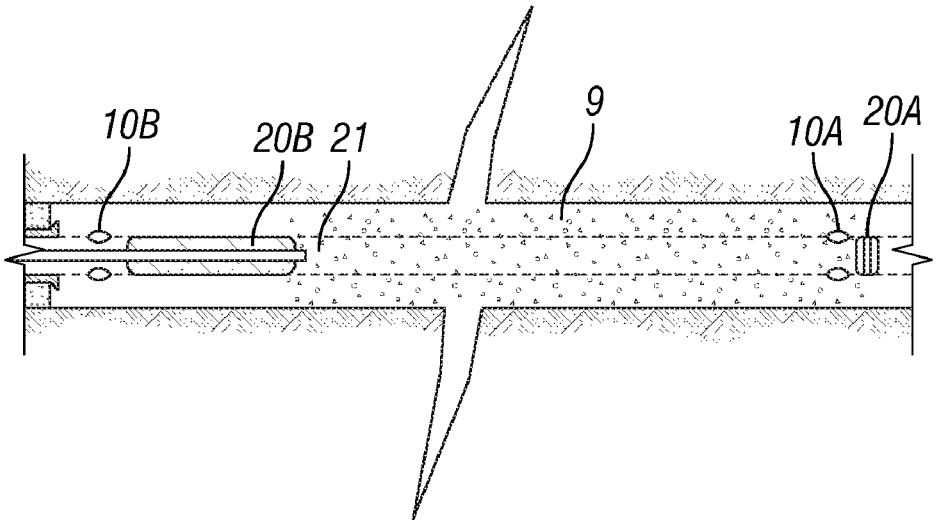
Figure 5E:
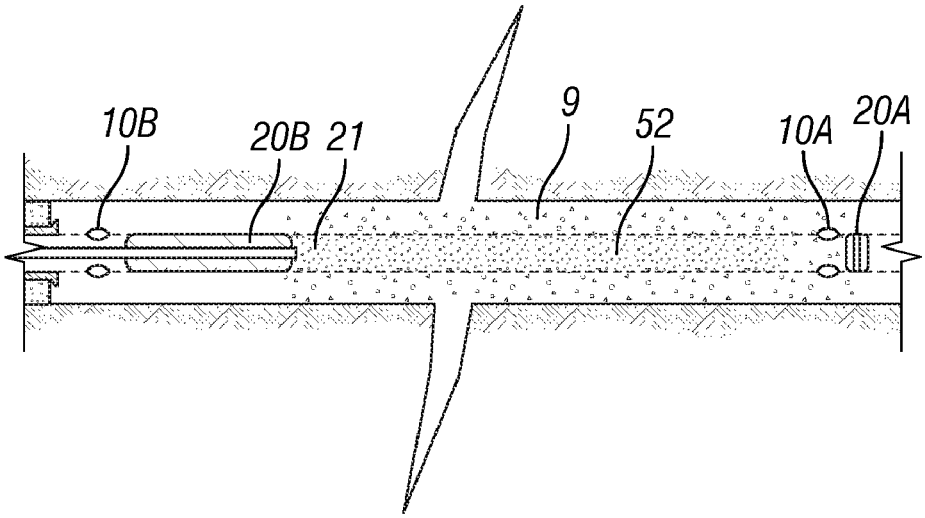
Figure 6A:
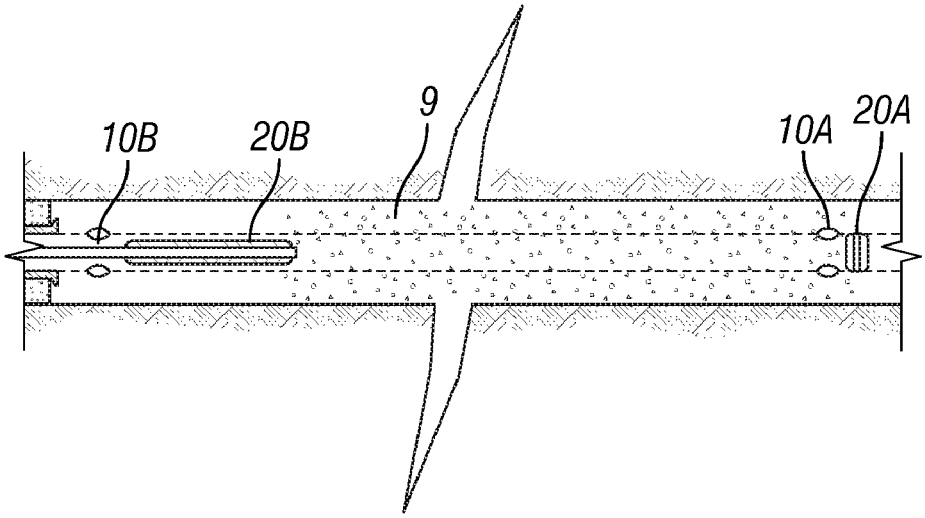
FIGS. 6A and 6B show a schematic diagram illustrating the further steps of the method of the invention: elimination of the second plug.
Figure 6B:
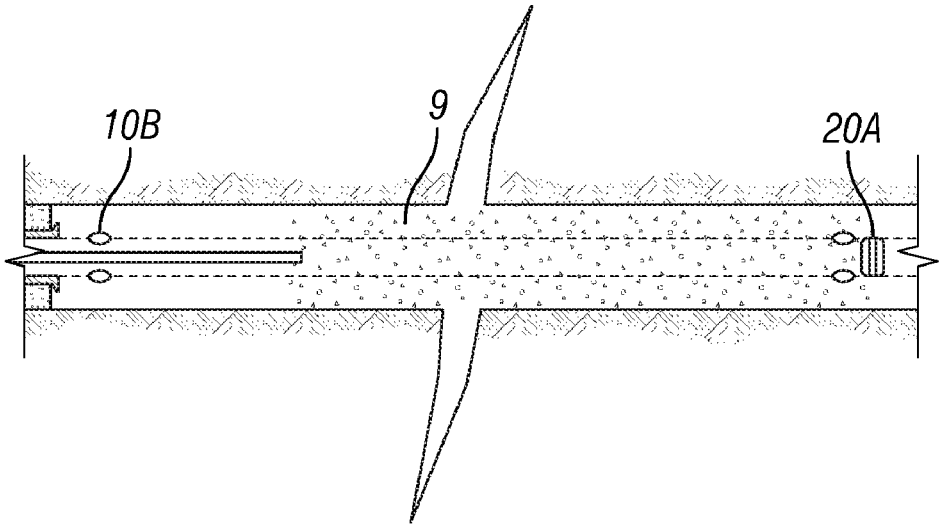

FIGS. 5A to 5E show the step of injection of cement. Cement 9 is pumped directly between the first and the second plugs through the nozzle/bit 21 after traveling the coil tubing (or drill pipe). The cement preferably also contains fibers (the fibers can be commercial fibers known as CEMNET™ or FIBERFRAC™). FIBERFRAC™ has the advantage to dissolve with heat and caustic conditions. Other type of setting material can be used: resin, geopolymer . . . . The cement was designed with the same density as the fluid. Once the cement exits the nozzle the cement bridges off against the fibers previously deposited by the fluid on the tube. The higher solids concentration of the cement increases the effectiveness of plugging the slots. Cement flow is directed axially along the tube toward the first opening (FIGS. 5A-5B). Finally, the cement emerges in the annulus via the first opening 10A and flows back along the annulus 11 (FIGS. 5C-5D). Cement does not come out of the slots above the first plug. In order to minimize the probability of cement falling back onto the coil tubing/drillpipe below second plug, the cement volume is calculated so the annular cement zone does not overlap the second plug on the coil tubing/drillpipe (FIG. 5D). As an example, the second plug may be up to 40 ft in length (however it may be longer or shorter) and this provides additional protection from uncertainties surrounding annular cement volume, such as open hole excess. FIG. 5E describes an optional method to displace the inside of the liner with a spacer fluid. The volume would not exceed the displacement volume of the liner (tubular volume between first plug and second plug). The advantage of this option is that it would contaminate the cement inside the liner and would assist drilling out the cement.

le;.5qFIGS. 6A and 6B show the step of eliminating the second plug. The second plug or other sealing device is unset from the tube. This allows the coil tubing/drillpipe to be pulled out of the hole. In order to maintain hydrostatic pressure and constant fluid volume inside the well, the fluid is injected on a 1:1 displacement. Alternatively, other type of second plug can be used, for example degradable plug as plug soluble in acid. The volume of coil being pulled out of the hole is matched by pumping fluid down the wellbore. After, the cement is given time to harden and reach the minimum compressive strength for drilling (FIG. 6B). Typically this value is 500 psi. This time can be controlled by varying the retarder/accelerator chemicals, considering the bottom hole temperature and pumping time requirements.

Figure 7A:
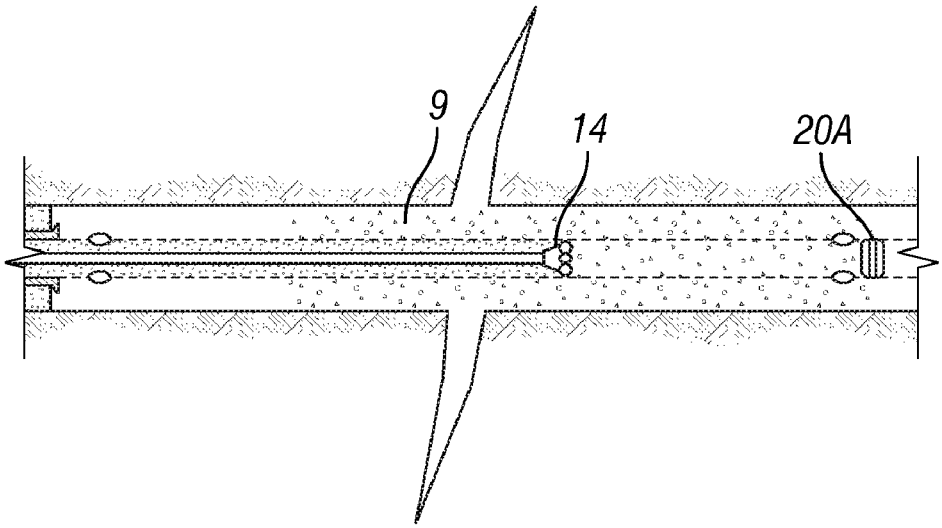
FIGS. 7A and 7B show a schematic diagram illustrating the drilling step of the method of the invention.
Figure 7B:
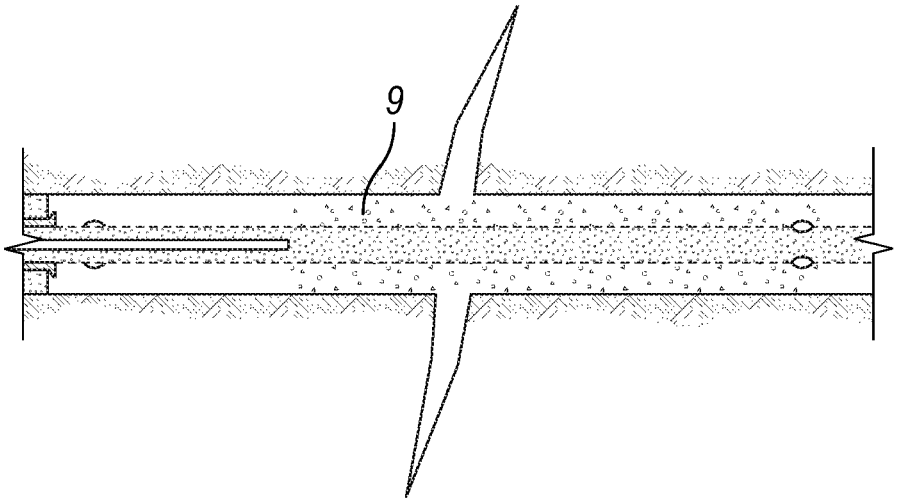

FIGS. 7A and 7B show the step of drilling. The cement and first plug inside the tube may be drilled/milled out with a drilling tool 14. This allows fluid access through the cement zone. Drilling out the cement will result in debris contaminating the wellbore around the cement zone. In addition the fluid+fibers could lead to contamination in this zone.

Figure 8A:
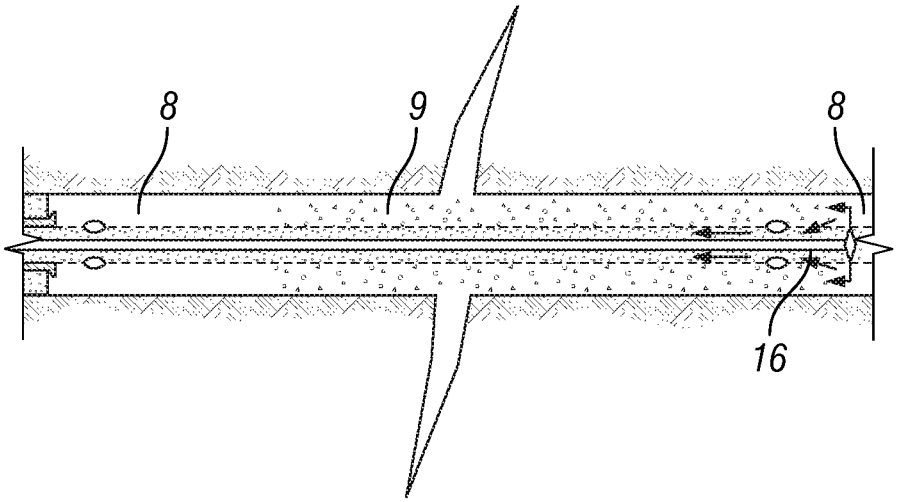
FIGS. 8A to 8E show a schematic diagram illustrating the optional further steps of the method of the invention: clean of the well.
Figure 8B:
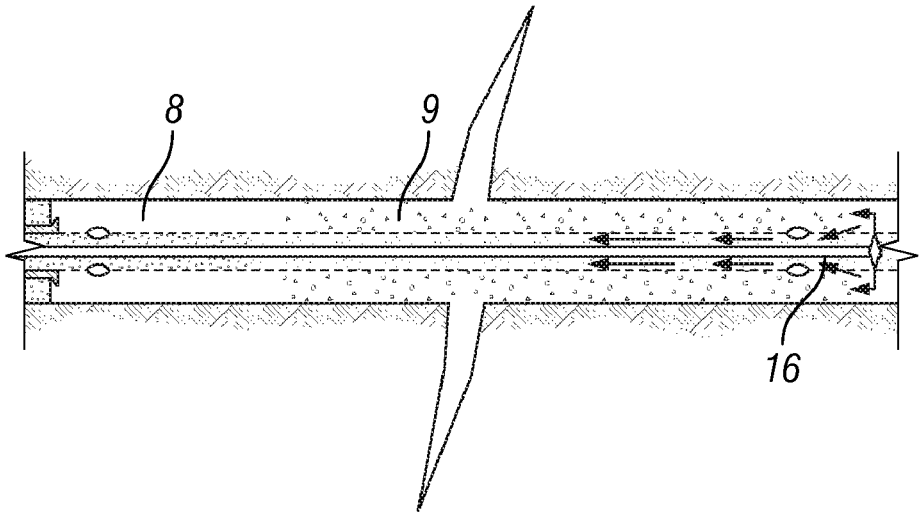
Figure 8C:
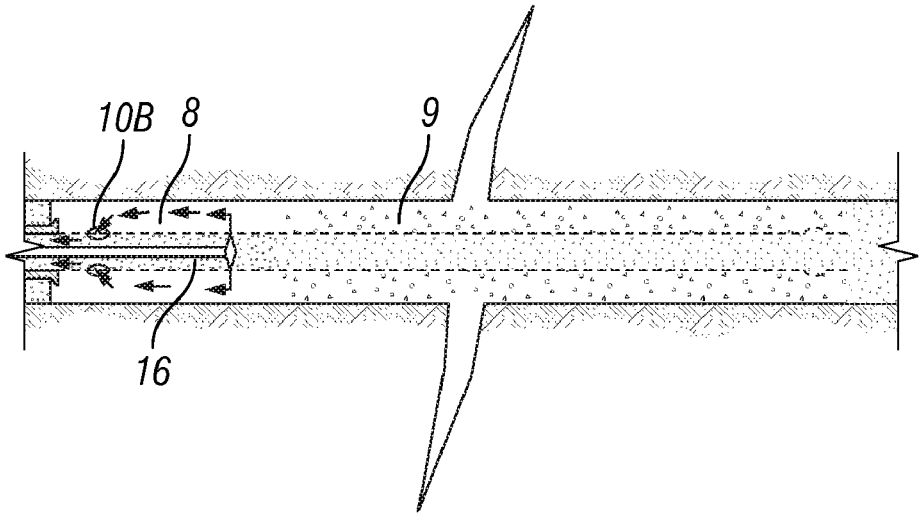
Figure 8D:
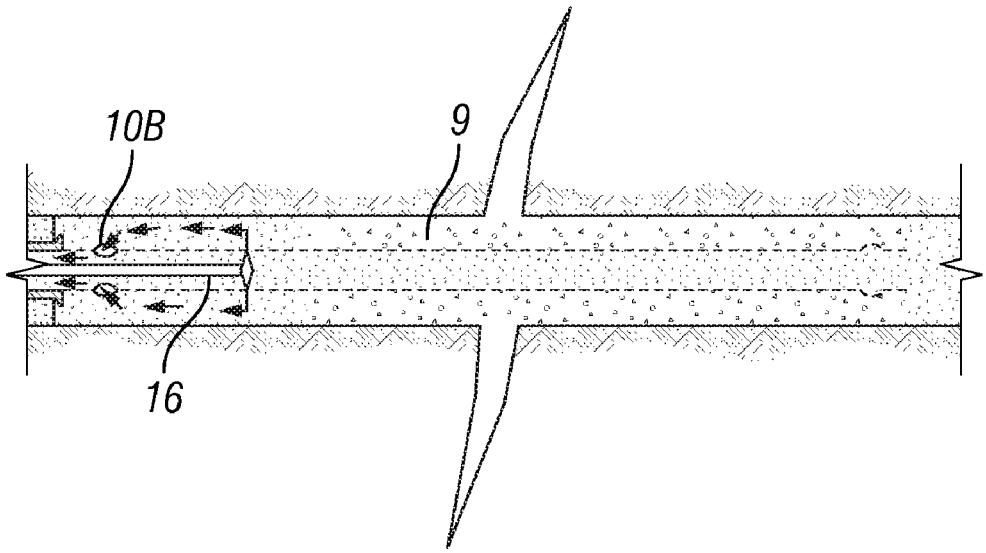
Figure 8E:
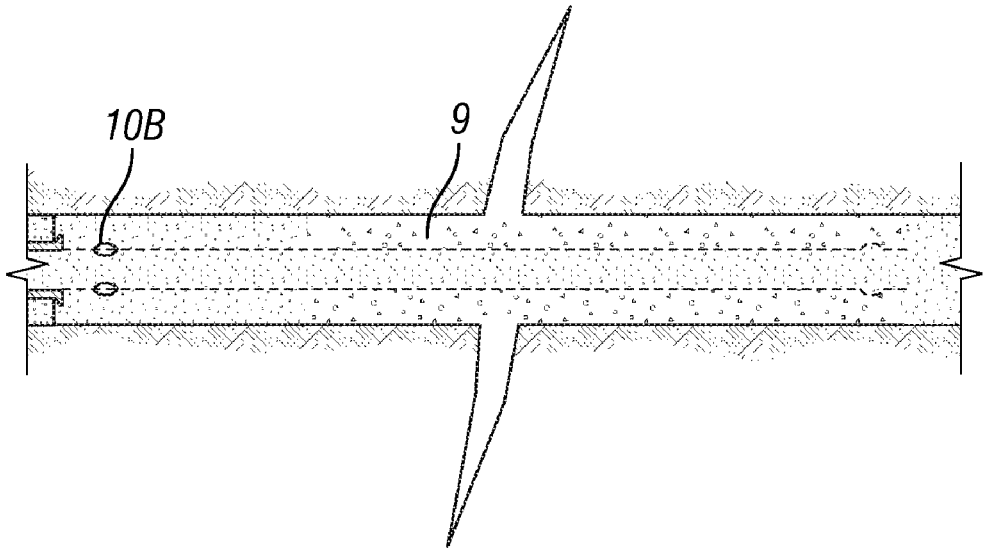

FIGS. 8A to 8E show an optional further step of cleaning the well. The contaminated zones may be cleaned out using a high powered jetting device 16, for example a commercial product known as JETBLASTER™. The device focuses high pressure fluid through the tube spaces. For convenience the contaminated section at the lower end would be cleaned out first i.e. the bottom of the tube (FIG. 8A). The cleaning fluid would flow into the annulus and push debris up against the cement zone. Fluid with low solids concentration would seep through the fibers and slots leaving the solids fibers deposited against the cement zone (FIG. 8B). This action reduces the skin damage in the lower region below the cement zone. The contaminated section at the upper section i.e. above the cemented zone would then be cleaned out using the high powered jetting device (FIG. 8C). In this case the slots of the tube would not have been cemented up, therefore the fluid jetted into the annulus would push debris, fluid and fibers from the annulus through the second opening and into the wellbore towards the surface (FIG. 8D). Result will be a good quality cement coverage in the zone 60 with minimal contamination at the lower zone and even less contamination at the upper zone (FIG. 8E).

Figure 9A:
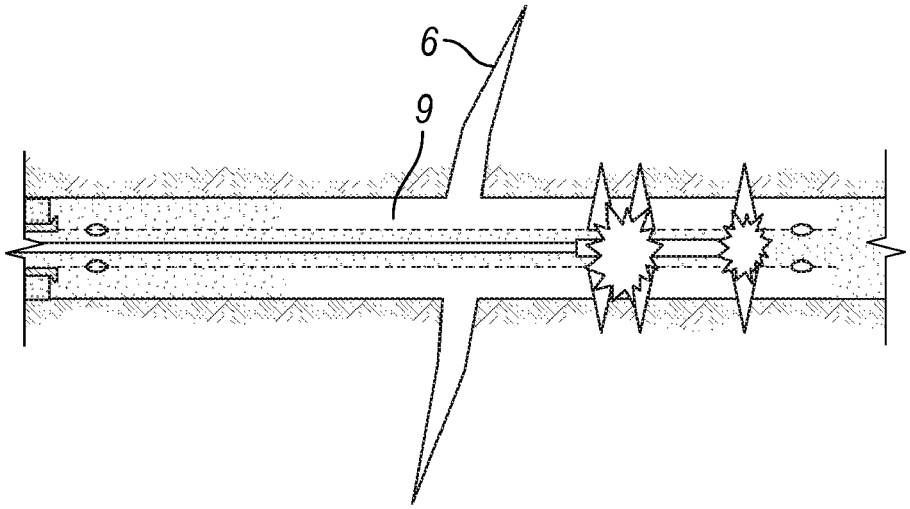
FIGS. 9A and 9B show a schematic diagram illustrating the optional further steps of the method of the invention: creation of a producing or injecting zone.
Figure 9B:
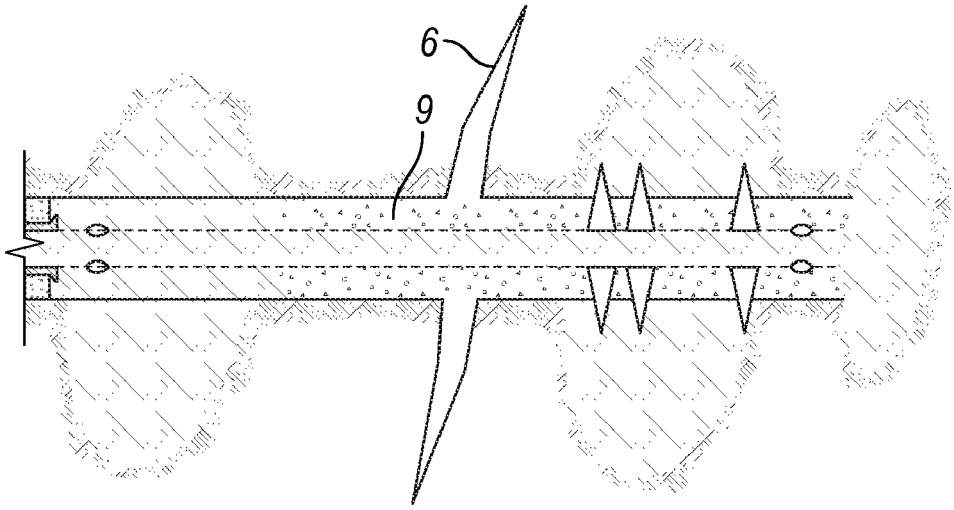

FIGS. 9A and 9B show an optional further step of creation of a production or injection zone. Perforation is done in the zone, via conventional perforating guns. And injection or production can continue for said zone.

EXAMPLE

Figure 10:
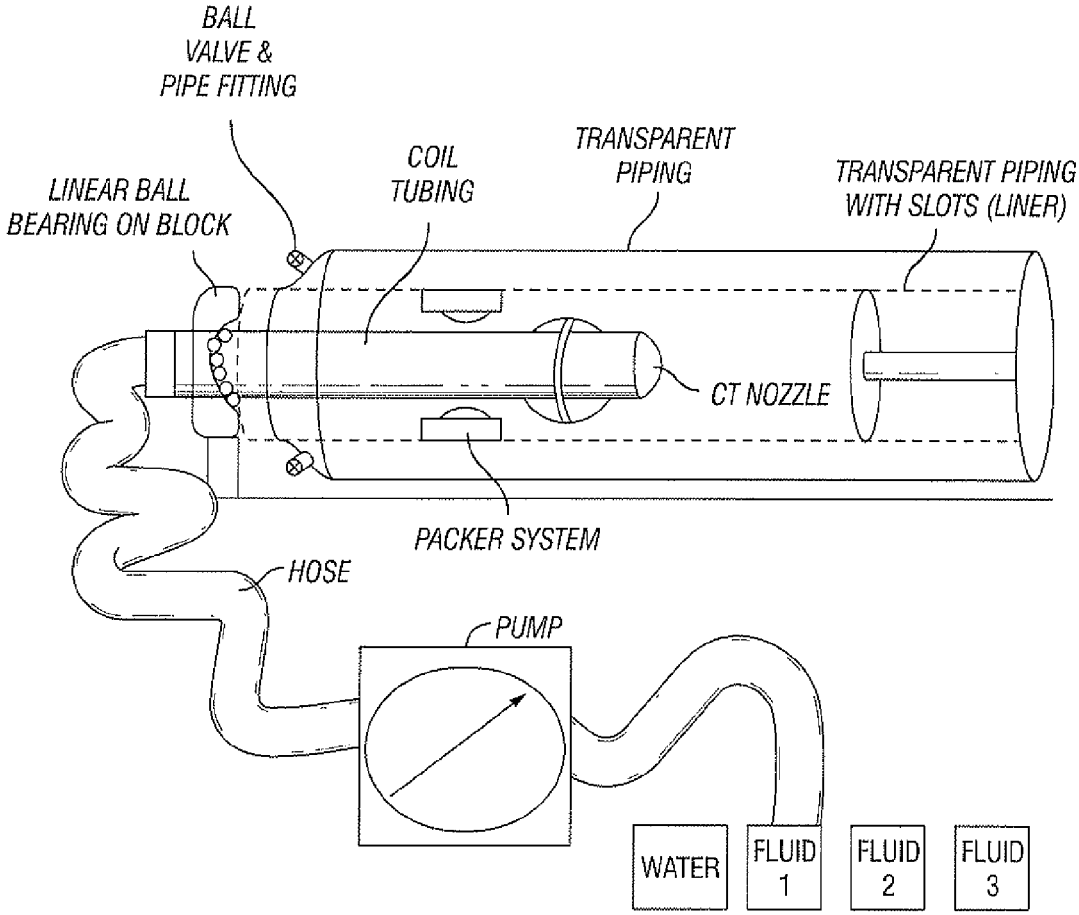
FIG. 10 shows a schematic diagram of the test setup model.

FIG. 10 illustrates the schematic for a yard test model. The yard test model was constructed to simulate the cement placement in a horizontal slotted liner. The model was constructed with transparent PVC pipe (with slots cut in to simulate a slotted liner, transparent PVC pipe (to represent the formation boundary) and coil tubing to represent the placement mechanism. The purpose of the model was to view the cement behavior in the current invention. The mechanism of the second plug is realized by pulling the nozzle back to seal the o-ring against a tapered block. The fluid and cement are pumped through tubing and into the slotted pipe. Fluid exits the model via ball valves located at the upper end of the model.

In the yard test model, the fluid 8 used is a spacer with fibers of the type CEMNET™. CEMNET™ is at a concentration of 6 lb/bbl. At this concentration a good coverage of the slotted liner is realized. The fibers continued to plug the slots and the spacer continued to flow axially along the slotted liner. However, the fibers concentration is not sufficient to plug the large perforated holes, and so the flow of the spacer along the annulus was observed during yard testing. A darker concentration of spacer at the lower end indicates that the spacer has traveled axially along the inner slotted liner and has emerged from the large holes into the slotted liner/outer pipe annulus. Another important observation was the impact of using equal density fluid. The original water in the model was sea water with a density of 8.6 ppg and the spacer was a commercial product known as MUDPUSH™ with density of 8.6 ppg. The spacer did not slump in the annulus; it maintained a relatively stable interface in both tests. This indicates that using similar density fluids prevents the slumping effect in horizontal liners. Once the spacer passes the COILFLATE™ packer the fluid is diverted to flow from the formation/liner annulus, through the upper perforations and towards the surface. The action of the spacer exiting the wellbore through large holes was simulated during the yard test. For sections where a significant distance exists between the upper perforations and the previous wellbore section a gel may be inserted above the upper perforations to assist with the flow diversion. Effectively, in the case of long horizontal sections, a significant distance may exist between the upper perforations and the previous casing section. In order to prevent spacer and fibers contaminating an excessive section of annulus a gel may be injected just above the upper perforations. The gel would develop high viscosity and would prevent spacer traveling too far past the upper perforations, this aiding the diversion of spacer and fibers into the larger hole sections. This step could be conducted at any time before spacer is injected. However in order to minimize the number of trips into the well this step would be included at the beginning of the job. In addition a gel may be injected above the sealing device and below the lower perforations. Examples of these gels include commercial products of the name ORGANOSEAL™ or PROTECTOZONE™. However any gel that develops high viscosity may be used.

Cement is pumped directly behind the spacer. The cement also contains fibers. In the yard test the fibers concentration in cement was 4 lb/bbl of CEMNET™, however any material that is used as plugging material may be used. The cement was designed with the same density as the spacer. In this test the cement was designed at 8.6 ppg. Once the cement exits the nozzle the cement bridges off against the fibers previously deposited by the spacer. The higher solids concentration of the cement increases the effectiveness of plugging the slots. Cement flow is directed axially along the slotted liner toward the lower perforations. The cement emerges in the annulus from the lower end and flows back along the outer annulus. Cement did not appear to be coming out of the slots above the lower zone and the cement did not appear to slump in the annulus. This was due to the similar density between the fluid ahead of the cement and the cement. Good cement coverage on the upper and lower annulus was observed. Another example realized with 8.3 ppg water ahead and 15.8 ppg cement and fibers show a significant slumping. This was due to the density difference between the cement and fluid ahead. This slumping was not noticed with the "neutral density" system used, where the spacer fluid and cement density were similar. In order to minimize the chance of stuck pipe, the spacer and cement should have the same density as the original fluid in the wellbore. This reduces the probability of stuck pipe due to differential hydrostatic pressure.

The invention claimed is:

1. A method of treating a zone of a well comprising a wellbore, a tube which is permeable to settable material, said tube forming an annulus with the wellbore; and wherein said zone is located in the annulus, the method comprises the steps of:

(i) placing inside said tube a first plug;

(ii) creating on said tube a first opening and a second opening, so that: the zone be located between said first and second openings and the first opening be located between said zone and said first plug;

(iii) placing inside said tube a second plug, so that said second plug is located between said second opening and said zone;

(iv) injecting a settable material inside said tube between said second and first plugs, so that settable material fills the annulus and the zone by passing through the first opening; and (v) eliminating said second plug.

2. The method of claim 1, further comprising the step of drilling inside said tube excess of material.

3. The method of claim 2, further comprising after the step of drilling inside said tube, the step of cleaning the inside of said tube to remove debris.

4. The method of claim 1, further comprising the step of waiting that the setting material sets.

5. The method of claim 1, further comprising the steps of:

(i) waiting that the setting material sets, and (ii) drilling inside said tube excess of set material.

6. The method of claim 5, further comprising after the step of drilling inside said tube, the step of cleaning the inside of said tube to remove debris.

7. The method of claim 1, further comprising after the step of placing inside said tube a second plug, the steps of:

(i) injecting inside said tube between said second and first plugs, a fluid comprising a lost circulation material;

(ii) circulating said fluid inside the tube and the annulus via the first and second openings, such that the lost circulation material fills opened surface of the tube and said tube becomes impermeable to said settable material.

8. The method of claim 7, wherein the density of the fluid comprising the lost circulation material and the density of the settable material are the same.

9. The method of claim 7, wherein the lost circulation material is made of fibers.

10. The method of claim 1, wherein the wellbore comprises a fracture near the zone, and the method further comprises the step of pre-treatment of the wellbore by filling the fracture with a gel.

11. The method of claim 1, wherein the step of creating the first opening is done by perforating the tube.

12. The method of claim 1, wherein the step of creating the second opening is done by perforating the tube.

13. The method of claim 1, wherein the step of placing the second plug is done by inflating a packer surrounding a setting pipe inside the tube.

14. The method of claim 13, wherein the step of injecting the settable material is done by injecting the settable material by the setting pipe.

15. The method of claim 13, wherein the step of eliminating the second plug is done by deflating the packer.

16. The method of claim 1, wherein the settable material further comprises a second lost circulation material.

17. The method of claim 16, wherein the second lost circulation material include fibers.

18. The method of claim 1, further comprising after the step of injecting the settable material, the step of injecting inside said tube between said second and first plugs, a second fluid following the settable material in such a way that said second fluid fills only the tube between first and second plugs and does not go into the annulus.

19. A method of cementing a zone of a well comprising a wellbore, a tube which is permeable to cement slurry, said tube forming an annulus with the wellbore; and wherein said zone is located in the annulus, the method comprises the steps of:

(i) placing inside said tube a first plug;

(ii) creating on said tube a first opening and a second opening, so that: the zone be located between said first and second openings and the first opening be located between said zone and said first plug;

(iii) placing inside said tube a second plug, so that said second plug is located between said second opening and said zone;

(iv) injecting cement inside said tube between said second and first plugs, so that cement fills the annulus and the zone by passing through the first opening;

(v) eliminating said second plug; and (vi) allowing the cement to set.

20. The method of claim 19, further comprising the step of drilling inside said tube excess of set cement.

21. The method of claim 20, further comprising after the step of drilling inside said tube, the step of cleaning the inside of said tube to remove debris.

22. The method of claim 20, wherein an initial fluid is present in the well, and wherein the cement density is chosen to be the density of the initial fluid.

23. The method of claim 20, wherein the cement injected is calculated to be the cement needed for the zone.

24. The method of claim 19, further comprising after the step of placing inside said tube a second plug, the steps of:

(i) injecting inside said tube between said second and first plugs, a fluid comprising a lost circulation material;

(ii) circulating said fluid inside the tube and the annulus via the first and second openings, such that the lost circulation material fills opened surface of the tube and said tube becomes impermeable to said cement slurry.

25. The method of claim 24, wherein the density of the fluid comprising the lost circulation material and the density of the cement slurry are the same.

26. The method of claim 24, wherein the lost circulation material is made of fibers.

27. The method of claim 19, further comprising after the step of injecting cement, the step of injecting inside said tube between said second and first plugs, a second fluid following cement in such a way that said second fluid fills only the tube between first and second plugs and does not go into the annulus.

* * * * *